US006733357B1

(12) United States Patent
Weiser

(10) Patent No.: US 6,733,357 B1
(45) Date of Patent: May 11, 2004

(54) GARDEN NOVELTY WITH UPRIGHT WING SUPPORTS

(75) Inventor: Margaret Weiser, Tarzana, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 0 days.

(21) Appl. No.: 10/646,065

(22) Filed: Aug. 21, 2003

(51) Int. Cl.[7] ..... A63H 33/40
(52) U.S. Cl. ..... 446/217; 73/170.05; D21/458
(58) Field of Search ..... 446/376, 486, 446/325, 326, 379–383, 217, 218; D21/412, 532, 458, 606–609; 116/264, 265, 22 A, DIG. 7, 273; 73/170.05

(56) References Cited

U.S. PATENT DOCUMENTS

| | | | | | |
|---|---|---|---|---|---|
| 174,866 | A | * | 3/1876 | Smith | 73/170.05 |
| 222,334 | A | * | 12/1879 | Walls | 40/455 |
| 1,442,290 | A | * | 1/1923 | Pallone | 40/455 |
| 1,446,835 | A | * | 2/1923 | Cook | 446/227 |
| 1,538,562 | A | * | 5/1925 | Koshalko | 446/201 |
| 1,751,433 | A | * | 3/1930 | Wallace | 73/170.05 |
| 2,760,303 | A | * | 8/1956 | Del Mas | 446/97 |
| 5,085,075 | A | * | 2/1992 | Baker | 73/170.05 |
| D337,358 | S | * | 7/1993 | Orak | D21/590 |
| D384,598 | S | * | 10/1997 | Park | D11/162 |
| D394,463 | S | * | 5/1998 | Filho | D21/458 |
| 6,206,747 | B1 | * | 3/2001 | Skwarek | 446/217 |
| 6,678,979 | B2 | * | 1/2004 | Lim et al. | 40/412 |

* cited by examiner

*Primary Examiner*—Jacob K. Ackum
*Assistant Examiner*—Bena B. Miller
(74) *Attorney, Agent, or Firm*—Cislo & Thomas LLP

(57) ABSTRACT

A spring novelty item which has a head and appendages attached to a body by means of a spring connecting means so as to add dynamic and aesthetic beauty to any garden, kitchen or other setting.

13 Claims, 2 Drawing Sheets

GARDEN NOVELTY WITH UPRIGHT WING SUPPORTS

BACKGROUND

Various novelty items are known wherein the novelty items represent various doll-like or whimsical figures wherein the appendages may have spring connections to the body. See, for example, U.S. Pat. No. 2,760,303 which is directed to ARTICULATED FIGURE TOY. In other instances a bird or the like having a body wherein the head is connected by a coil spring is shown in U.S. Design Pat. No. 337,358 entitled LINKING BIRD. While these prior art novelty items may be useful, there remains a need for a novelty item that can be more easily packaged and assembled.

SUMMARY

Exemplary embodiments described herein are directed to a whimsical caricature wherein a body has associated therewith either wings, arms, head and legs each of which are connected by a spring means or coil spring having a K-factor that is relatively and selectively chosen such that, depending upon the weight of the appendage being supported, the same may be easily moved through vibrational or other forces impacted thereon relative to the body with which it is associated.

More specifically, one or more spring means are coupled to the body through upright support members. That is, these support members may be substantially perpendicular to the horizontal axis of the body. By providing upright support members, the appendages associated with the novelty item may be removed so as to facilitate packaging of the item. While one exemplary embodiment may be described in specific detail with regard to a bird and cartoon-like article, it is not to be so narrowly construed inasmuch as the same inventive concept may be applied to humans, vertebrates, animals, insects, fish or the like, it only being important that the appendages of the simulated article be connected to a body of a spring connecting means which may take the configuration of a coil spring. According to one exemplary embodiment, however, other spring configurations may be utilized just so long as the attributes of the disclosed exemplary embodiments are obtained.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments. However, it is to be understood that the same or equivalent functions and sequences may be accomplished by different embodiments that are also intended to be encompassed within the spirit and scope of the invention.

The exemplary embodiments are directed to a novelty item comprising the combination of a simulated vertebrate, animal, bird or the like having a head, a body and appendages, each of said head and appendages being operatively connected to the body through a spring connecting means wherein the K-factor of the spring connecting means is such as to allow each of the head and appendages to be easily movable through spring action relative to the body and to be freely and easily movable thereto. According to one exemplary embodiment being directed to a garden item, at least one stake means extends from the body.

Figure 1:
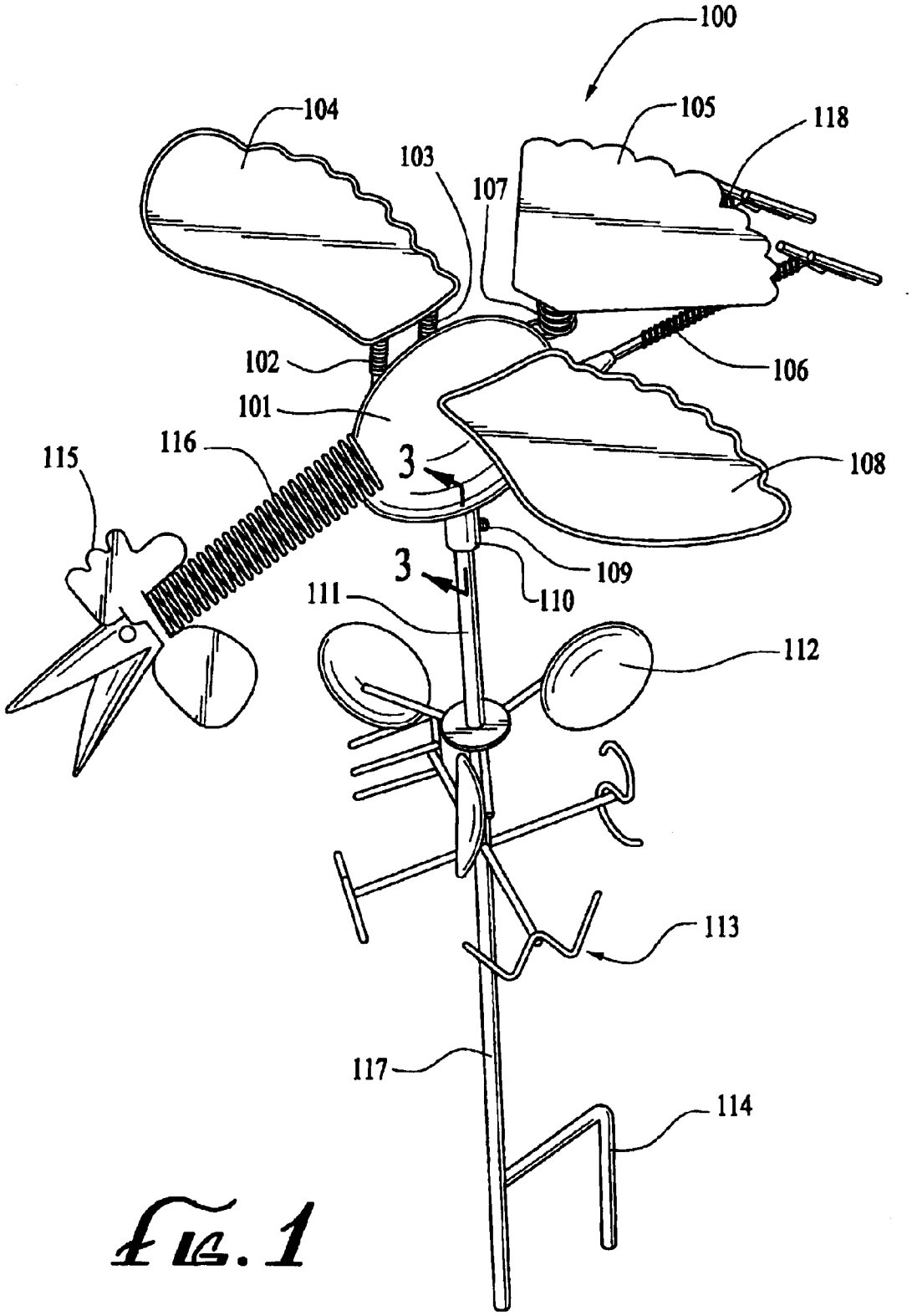
FIG. 1 is a perspective view of an exemplary, decorative novelty item embodied in a whimsical bird.
Figure 2:
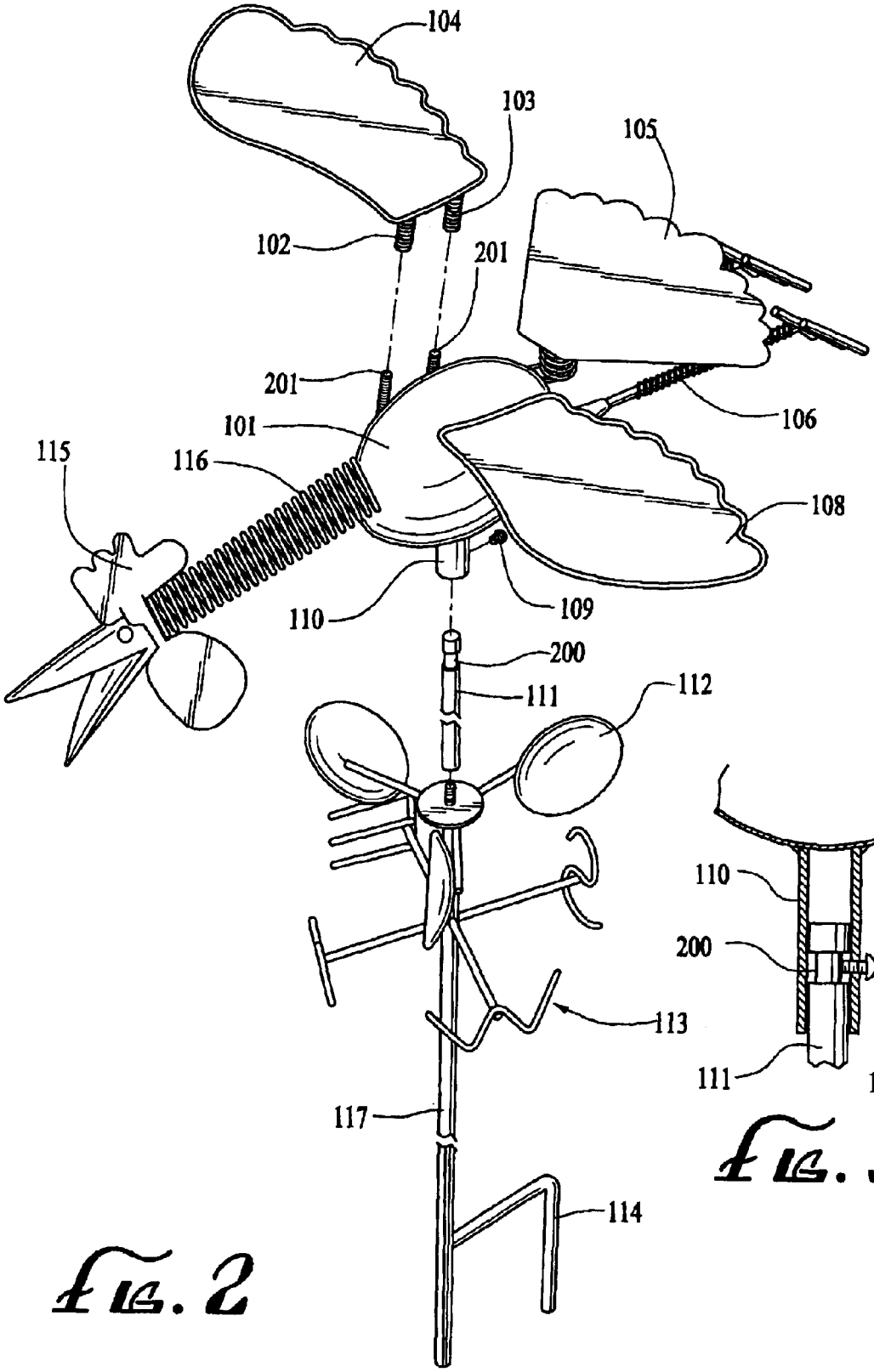
FIG. 2 is an exploded perspective view of the exemplary novelty item shown in FIG. 1.

Referring to FIGS. 1–2 of the drawing wherein like members of reference designate like elements throughout it will be seen that the novelty item in this particular instance takes the form of an avian caricature and it will be seen that the garden novelty 100 as indicated takes the form of a bird having a body 101, a head 115 and wings 104, 108, tail 105, and legs 106, 118 and wherein it will be noted that each of the head, wings, tail, and appendages are associated with the body 101 by means of a spring connecting means 102, 103, 106, 107, 116, respectively.

With respect to the spring connecting means 116 it will be seen that the same takes the form, in one embodiment, of a coil spring somewhat extensive in length and having a K-factor such that when the garden novelty 100 is staked or placed on its stand in the garden or the like so that vibrational movement of the ground or movement caused by the wind will impart dynamic action and movement of the head 115 relative to the body 101.

Likewise the wings 104, 108, and the tail 105 are associated with the body 101 through spring connectors 102, 103, 107 taking the form of coil springs but being substantially shorter in length but again having a K-factor that depending upon the weight of the wings 102, 103 is such that vibrational movement either imparted through the novelty item 100 from the ground or by means of a wind in the ambient atmosphere in which the ornamental novelty 100 is placed, will cause the wings to have some dynamic action or simulated flapping thereof.

According to one exemplary embodiment, the wings 104, 108 may be fabricated of a wire mesh and overlaid thereon with a thin, metal enameled representation of feather plates. These metal plates may be configured to simulate feathers and may be of various colors and may be chosen to be whimsical in nature and preferably are of a high lacquer finish so that the same will withstand the ambient elements as well as be reflective and pleasing to look at. The same may be said for the exterior finish of the remainder of the novelty item 100 with the colors for the head and legs, etc. being selected as a matter of choice, the same being chosen so as to make the ornamental novelty 100 as attractive to the eye as possible depending upon the end result to be obtained.

As shown in FIG. 2, the wings 104, 108 are releasably coupled to the body 101 by upright members 201. According to one exemplary embodiment, the upright members are positioned on the body so as to be substantially perpendicular to the horizontal axis of the novelty item. As those skilled in the art will appreciate, the upright members 201 may be positioned on the body 101 of the novelty item 100 in any number of angles. For example, according to one exemplary embodiment, the upright members may be substantially parallel to the horizontal axis of the novelty item. The upright members 201 may be welded, soldered, or otherwise tacked onto the body 101. Because the wings 104, 108 may be removed from the upright members 201, the novelty item 100 may more easily be stored and/or packaged as the container holding the novelty item may be smaller as compared to those novelty items where the wings are permanently attached to the body.

According to one exemplary embodiment, the legs 106, 108 may be directly coupled to the body 101. In another exemplary embodiment, the legs may be composed of a first rod portion coupled to a second rod portion by a coil spring. That is, the leg configuration of this embodiment simulates a leg wherein the first rod portion corresponds to a thigh, the coil spring corresponds to a knee, and the second rod portion corresponds to the lower leg.

The novelty item 100 may be coupled to a means for securing the item to a horizontal or vertical surface such as, but not limited to, the ground, a wall, window, door or the like. According to one exemplary embodiment, the securing means may be a unitary shaft. In another exemplary embodiment, the securing means may be shaft having one or more shaft components coupled together to form a unitary shaft. In the exemplary embodiment depicted in FIGS. 1–2, the securing means is a shaft having an upper shaft 111 and a lower shaft 117.

Figure 3:
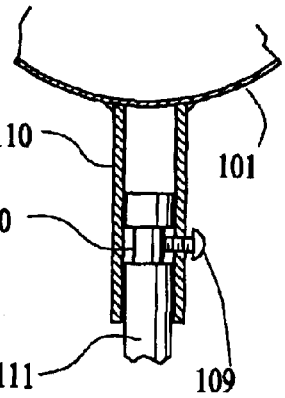
FIG. 3 is a cross-sectional view taken along line 3—3 of FIG. 1.

As shown in FIGS. 1–2, the securing means is coupled to the base of the body 101 through a sleeve 110. The sleeve 110 extends from the outer surface of the body 101 and defines a bore that is sized to receive the upper shaft 111. The sleeve 110 may also include a passage that intersects the bore. A screw 109 or other coupling means know or developed in the art may be inserted through the passage to ensure that the novelty item 100 is securely coupled to the upper shaft 111 as shown in FIG. 3.

In one exemplary embodiment, a groove 200 may be provided about the periphery of the first end of the shaft 111. At the second or opposite end of the shaft 117, a means for staking or standing the novelty item on the surface is provided. As shown in FIGS. 1–2, a L-shaped staking member 114 is coupled to the shaft 117. As those skilled in the art will appreciate, the staking member 114 may have a plurality of forks and/or shapes. As shown in FIGS. 1–2, the portion of the staking member 114 that is substantially perpendicular with the shaft 117 provides a surface to allow an individual to "step" the staking means into the ground.

Also, as shown in FIGS. 1–2, the shaft 111, 117 may include other features such as an anemometer 112 and/or a wind directional indicator 113. In various exemplary embodiments, the anemometer 112 may be a 3-cup style or a propeller-type style. The anemometer 112 is coupled to the shaft 111, 117 so that the anemometer 112 may spin about the shaft 111, 117.

In another exemplary embodiment, rather than having a stake or other piercing element, the shaft 117 may terminate at a stand (not shown) that is rectangularly shaped and of cast metal or other materials of sufficient weight in order to support the novelty item 100. Where it is desired to have the novelty item 100 supported, for example, from a metal object, the body 101 may be provided with a threaded aperture, which receives a magnet member (not shown) by means of a threaded bolt or the like. In like fashion where it is desired to have a support other than magnet, a suction cup may be substituted for the magnet in which event the suction cup is threaded into the threaded aperture by means of a threaded bolt for attachment to a surface as those of ordinary skill in the art will at once recognize.

While the invention has been described with respect to a simulated vertebrate and bird, those of ordinary skill in the art will of course recognize that the same principles may be applied to other animals, fish, insects and the like wherein it is desired to have a whimsical, dynamically active novelty item for garden, kitchen or the like it only being important that the head and appendages, whether they be arms, wings or legs or the like, be connected to a body through a spring connecting means which allows for easy association and disassociation of the spring supported members or appendages from the body of the novelty.

Further, those of ordinary skill in the art will recognize that the spring connectors, their K-factors, weight and size will be dictated by the appendage or body it is intended to support and still achieve the movement of the novelty desired.

Thus, there has been disclosed a whimsical novelty article taking the form of a whimsical vertebrate, bird, animal or the like that will add dynamic pleasure to any setting whether it be garden, kitchen or other setting.

What is claimed is:

1. A novelty item, comprising:

a simulated animal, bird, or vertebrate comprising a head and a body having one or more upright support members, and one or more appendages releasably supported from said one or more upright support members wherein said head is coupled to the body by a spring means and said one or more appendages are held to the corresponding one or more upright support members by the weight thereof; and a securement means for securing said simulated animal, bird, or vertebrate to a surface, wherein the securing means extends from said body.

2. The novelty item of claim 1 wherein said securement means comprises a shaft and further comprising an anemometer positioned on said shaft.

3. The novelty item of claim 1 further comprising a wind directional indicator positioned on said securement means.

4. The novelty item of claim 1 wherein the securing means comprises a sleeve secured to the body, wherein the sleeve defines a bore sized to receive a shaft, the shaft comprising a first end and a second end, the first end having a groove provided about the periphery of the shaft.

5. The novelty item of claim 4 wherein the sleeve further comprises a passage that intersects the bore, wherein a coupling means is insertable into the bore and is capable of contacting the groove.

6. The novelty item of claim 4 wherein one or more staking members are coupled to the second end of the shaft.

7. The novelty item of claim 4 wherein a stand is coupled to the second end of the shaft.

8. A novelty item, comprising:

a simulated animal, bird, or vertebrate comprising a head, a body having one or more upright support members, a sleeve extending from a base of the body, and one or more appendages, wherein the head is coupled to the body by a spring means and one or more appendages are releasably coupled to the corresponding one or more upright support members;

the sleeve comprising a first bore and a second bore, wherein the first bore intersects the second bore, wherein the first bore is sized to receive a shaft and the a second bore is sized to receive a coupling means; and the shaft comprising a first end and a second end, the first end having a groove provided about the periphery of the shaft and the second end having a means for standing the simulated animal, bird, or vertebrate substantially upright.

9. The novelty item of claim 8 further comprising an anemometer positioned on the shaft.

10. The novelty item of claim 9 further comprising a wind directional indicator positioned on the shaft.

11. The novelty item of claim 8 wherein the standing means comprises one or more staking members are coupled to the second end of the shaft.

12. The novelty item of claim 8 wherein the standing means comprises a weighted base.

13. A novelty item comprising:

a simulated animal, bird, or vertebrate comprising a head, a body having one or more upright support members, a sleeve extending from a base of the body, and one or more appendages, wherein the head is coupled to the body by a spring means and the one or more appendages are slidably and releasably coupled to the corresponding one or more upright support members;

the sleeve comprising a first bore and a second bore, wherein the first bore intersects the second bore, wherein the first bore is sized to receive a shaft and the second bore is sized to receive a set screw; and the shaft comprising a first end and a second end, the first end having a groove provided about the periphery of the shaft and one or more staking members coupled to the second end of the shaft;

an anemometer positioned on the shaft between the first end and the second end of the shaft; and a wind directional indicator positioned on the shaft between the first end and the second end.

* * * * *